United States Patent [19]

Itoh

[11] Patent Number: 4,917,031

[45] Date of Patent: Apr. 17, 1990

[54] CLOTH-PATTERN SENSING DEVICE FOR A SEWING MACHINE

[75] Inventor: Hirosumi Itoh, Nagoya, Japan

[73] Assignee: Brother Kogyo Kabushiki Kaisha, Japan

[21] Appl. No.: 287,283

[22] Filed: Dec. 21, 1988

[30] Foreign Application Priority Data

Dec. 23, 1987 [JP] Japan ..... 62-326364

[51] Int. Cl.[4] ..... D05B 19/00; D05B 27/06; D05B 27/08; G01J 1/28

[52] U.S. Cl. ..... 112/121.11; 112/314; 112/320; 250/205

[58] Field of Search ..... 112/121.11, 121.12, 112/314, 313, 320, 315, 272; 250/205

[56] References Cited

U.S. PATENT DOCUMENTS

| | | | |
|---|---|---|---|
| 4,565,140 | 1/1986 | Martell et al. | 112/121.11 |
| 4,612,867 | 9/1986 | Rösch et al. | 112/314 |
| 4,732,095 | 3/1988 | Saito et al. | 112/121.11 |
| 4,757,773 | 7/1988 | Nomura et al. | 112/121.11 |
| 4,766,828 | 8/1988 | Nomura et al. | 112/314 |
| 4,769,532 | 9/1988 | Kawakami | 250/205 |

FOREIGN PATENT DOCUMENTS

| | | |
|---|---|---|
| 58-50487 | 3/1983 | Japan . |
| 60-85385 | 5/1985 | Japan . |
| 60-85386 | 5/1985 | Japan . |
| 63-49186 | 3/1988 | Japan . |
| 63-127785 | 5/1988 | Japan . |

*Primary Examiner*—Peter Nerbun
*Attorney, Agent, or Firm*—Oliff & Berridge

[57] ABSTRACT

A device for performing an initial setting of a photosensor of a sewing machine including a light-emitting element and a light-receiving element. The device adjusts the strength of light emitted by the light-emitting element so that the output of the light-receiving element responding to the emitted light falls within a preset normal range. Thus the output from the light-receiving element is normalized and the photo-sensor can correctly discriminate various levels of reflectance, i.e., between a pattern signal and a cloth-edge signal, or among pattern signals of various brightnesses.

9 Claims, 6 Drawing Sheets

CLOTH-PATTERN SENSING DEVICE FOR A SEWING MACHINE

BACKGROUND

The present invention relates to a photo-sensing device for sensing patterns on cloths in a sewing machine, especially to a normalization setting of the photo-sensing device.

Photo-sensors are widely used in industrial machines and robots. In a sewing machine disclosed in the U.S. Pat. No. 4,612,867, two photo-sensors are used to sense patterns on two cloths having the same pattern in order to sew them with their patterns matching. Each of the photo-sensors includes a light-emitting element that casts light on a cloth and a light-receiving element that senses its pattern. The assignee of the present application has filed a Japanese Patent Application No. S61-274563 (now Published Unexamined Japanese Patent Application No. S63-127785) in which one photo-sensor is used in a pattern-matching sewing machine in two ways: for sensing patterns, and for detecting a cloth-edge. When a cloth ends at the light-casting or detecting spot, the light is reflected by a high-reflectance plate instead of by the low-reflectance cloth surface.

In the latter sewing machine, the photo-sensor system treats two kinds of photo-signals: a pattern signal, and a cloth-edge signal. A problem with this pattern-matching sewing machine arises when the light-emitting element or the light-receiving element degenerates during use. The photosensor system is calibrated at its creation so that the strength of light emitted from the light-emitting element is at an appropriate level and, as shown in FIG. 5, the pattern signals generated by the light-receiving element fall between V1 and V2, and the cloth-edge signal is around V3, all of which are within output voltage levels corresponding to the normal sensitivity range of the light-receiving element. The output voltage of the light-receiving element is almost proportional to the strength of the received light in the normal sensitivity range, but saturates over a certain upper limit because the output voltage cannot exceed the source voltage Vcc of the sensor. Since V1, V2 and V3 are all generated by one light-receiving element, the pattern signal and the cloth-edge signal change correspondingly to each other.

When V3 decreases, for example, due to aging or thermal drift of the light-emitting element or the light-receiving element, or due to variations in the efficiency of individual sensors, or due to a mis-alignment of the optical path, V1 and V2 also decrease, their voltage latitude becomes narrower, and the pattern sensing becomes difficult. In this case, an amplification of the output voltage of the light-receiving element will not work well because noise signals (such as from ambient light) would also be amplified. When, on the contrary, V3 increases, V2 and V3 come closer because V3 approaches its upper limit, so the pattern signal and the cloth-edge signal may be confused.

In Published Unexamined Japanese Patent Application No. S60-85385, a controller for a photo-sensor of a sewing machine is disclosed. The photo-sensor is used to detect cloth edges and overlapping areas of cloths between a light-emitting element and a light-receiving element. The sensor controller adjusts the strength of light emitted by the light-emitting element according to the thickness of the cloth to properly detect the cloth-edge and the overlapping area. This sensor controller, however, only changes the strength of the emitted light; it does not address the normal operable sensitivity range or the effective sensitivity range of the light-receiving element. Thus, the sensor controller cannot compensate for changes in the efficiency of the light-emitting element or the light-receiving element.

SUMMARY OF THE INVENTION

An object of the present invention is to make a cloth-pattern sensing device that compensates for changes in or of the elements to obtain normal output signals from the light-receiving element.

Another object is to make a pattern-matching sewing machine in which the pattern signal and the cloth-edge signal are always correctly discriminated.

A photo-sensing device according to the present invention is used in a sewing machine for sensing patterns on cloths, and comprises: a light-emitting element and a light-receiving element; a standard reflection surface for reflecting the light from the light-emitting element to the light receiving element with a fixed reflectance; a memory for storing preset upper and lower limit output values for the light-receiving element corresponding the light reflected by the standard reflection surface; and an emitter controller for controlling the strength of light emitted from the light-emitting element so that the light-receiving element, in response to the standard light, generates an output within the upper and lower limit values. The upper and lower limit values for the standard reflection light is determined so that the light reflected by cloth patterns falls within the normal operable range of the light-receiving element. The standard reflection surface may be a mirror plate or a cloth of a fixed color. Details of the invention will be better understood by referring to the most preferred embodiment of the invention explained below.

DESCRIPTION OF A PREFERRED EMBODIMENT

Figure 6:
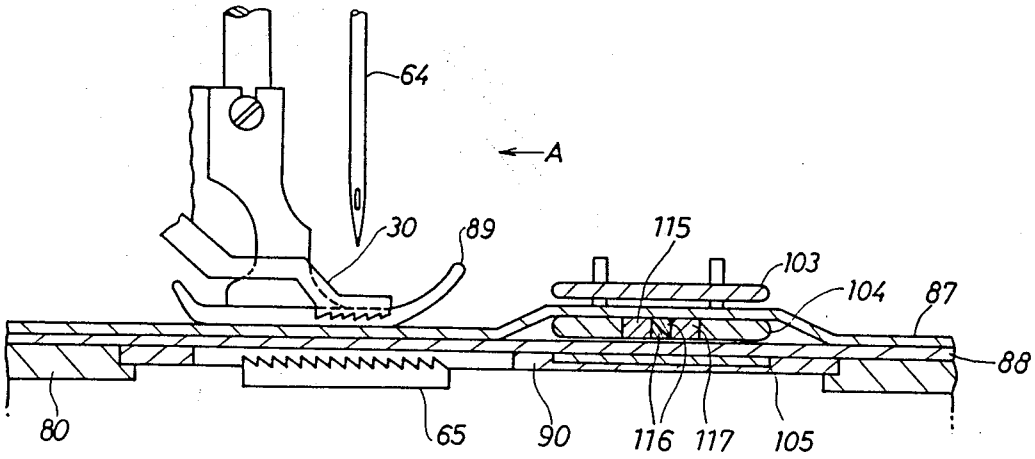
FIG. 6 is a sectional view of the sewing machine at the sewing point and the photo-sensing point.
Figure 7:
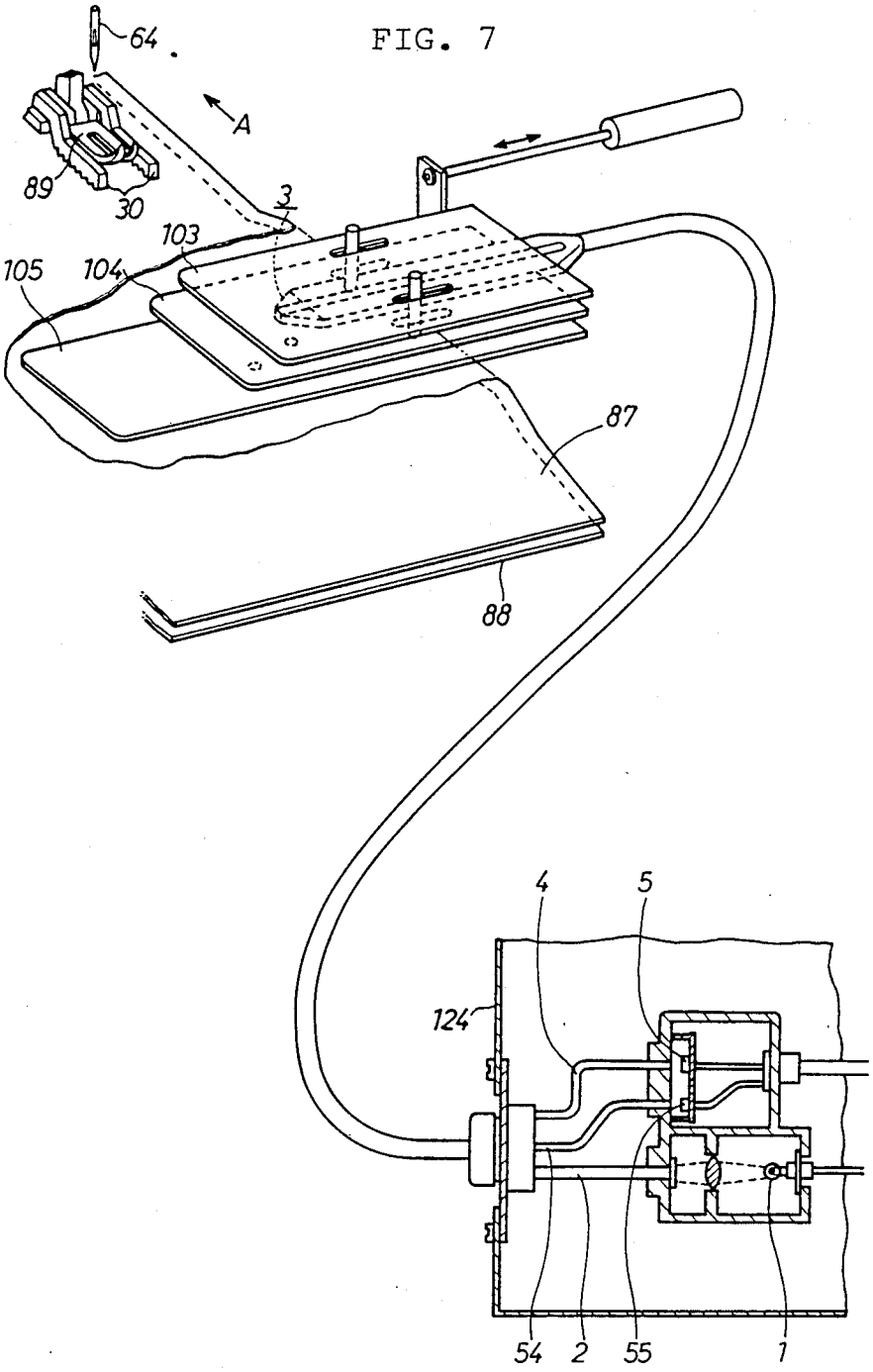
FIG. 7 is a schematic view of the photo-sensing apparatus of the sewing machine.

The cloth-pattern sensor of the present invention is embodied in a pattern-matching sewing machine. First, the sewing machine is explained with reference to FIGS. 6 and 7.

Two cloths 87 and 88 on the machine bed 80 are sewn together by the synchronous movement of a needle 64 reciprocating through a hole in a needle plate 90 and a loop taker (not shown) under the needle plate 90. Below the needle plate 90 and near the dropping point of the needle 64 are lower feed dogs 65 which perform a four-motion feed: they rise to press the cloths 87 and 88 against a presser foot 89, feed the cloths 87 and 88 forward (in direction A), fall down, and return. At both sides of the presser foot 89 are upper-feed dogs 30 which also perform a four-motion feed. The upper-feed dogs 30 are connected to an upper-feed adjusting mechanism 51 (FIG. 1) that drives the upper-feed dogs 30 to effect a supplementary relative movement of the upper cloth 87 against the lower cloth 88 to align the patterns of the two cloths 87 and 88. Three guide plates 103, 104 and 105 are provided before the sewing point. The lowest guide plate 105 is flush with the needle plate 90 and the other two guide plates 104 and 103 are placed parallel to the lowest guide plate 105 to separate the lower and upper cloths 88 and 87.

A sensing probe 3 is embedded in the middle guide plate 104 to sense patterns on the upper and lower cloths 87 and 88 and also to sense the edge of the cloths 87 and 88. The probe 3 has two peripheral prisms 115 and 117 and a pair of center prisms 116 at its tip. The surfaces of the upper and lower guide plates 103 and 105 opposing the tip of the probe 3 have reflectance higher than a brightest cloth surface, functioning as a cloth-edge detector and as the standard reflection surfaces. The prism 117 is connected to a lighting fiber bundle 2 and a sensing fiber bundle 4 for the upper cloth 87; the prism 115 is connected to another lighting fiber bundle 2 and a sensing fiber bundle 54 for the lower cloth 88; and the prism pair 116 reflect light from the prisms 115 and 117 to the lower and upper cloths 88 and 87 (or to the lower and upper guide plates 105 and 103) and light from the cloths 88 and 87 (or from the guide plates 105 and 103) to the prisms 115 and 117.

The fiber bundles 2, 4 and 54 connect the sensing probe 3 and a remote sensor main unit 124. The ends of the lighting fibers 2 face a light source (incandescent lamp) 1, the upper sensing fibers 4 face a photo-sensor 5 for the upper cloth 87, and the lower sensing fibers 54 face another photo-sensor 55 for the lower cloth 88. The optical system of the present embodiment is detailed in the U.S. Pat. No. 4,766,828 of the same assignee.

Figure 1:
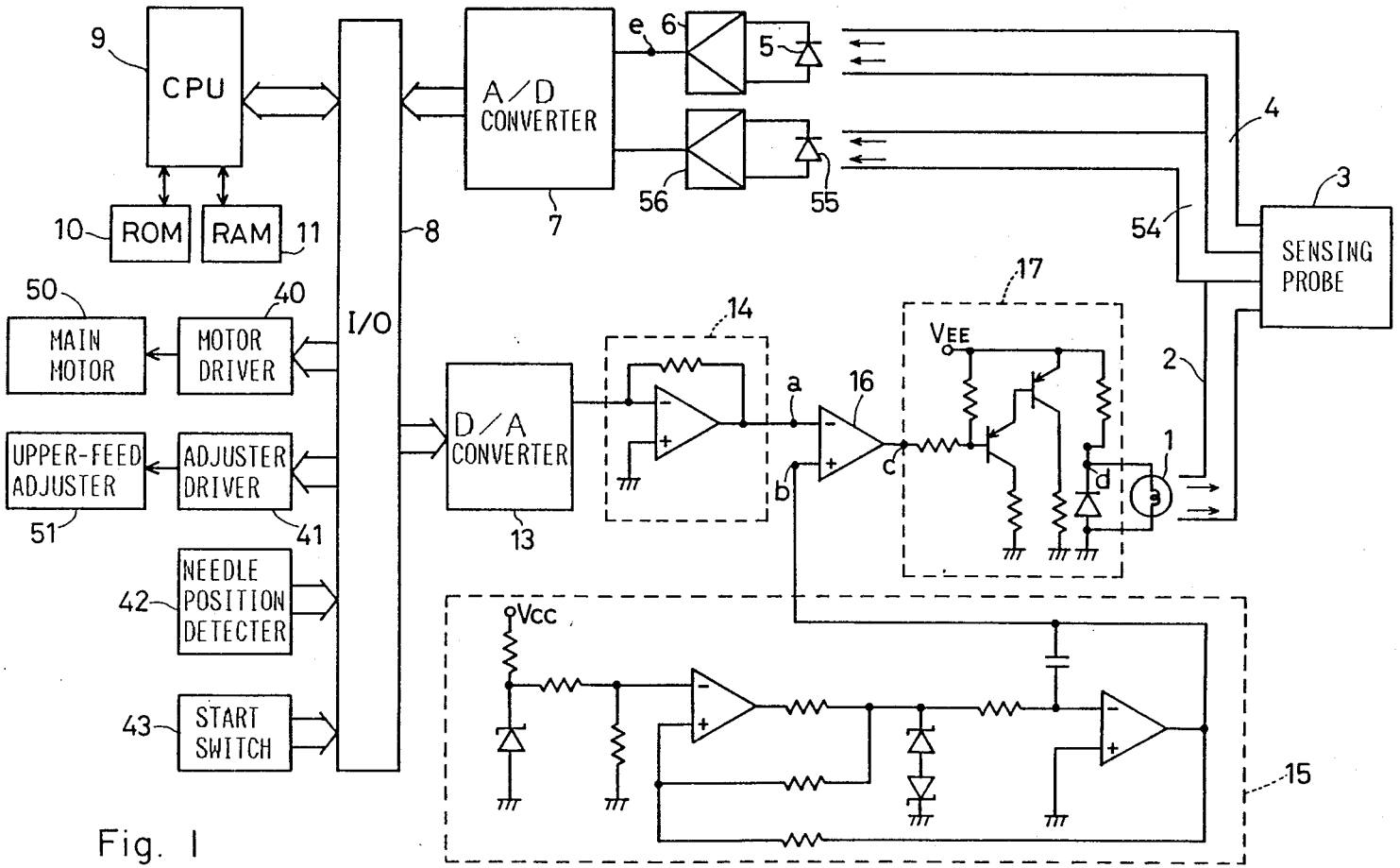
FIG. 1 is an electrical block diagram of a pattern-matching sewing machine embodying the present invention.

In the photo-sensing system, as illustrated in FIG. 1, the light from the lamp 1 is sent, via the lighting fibers 2, to the sensing probe 3 and spotted on the cloths 87 and 88 or on the guide plates 103 and 105. The reflected light including the pattern signal (if cloths 87 and 88 are present) or the cloth-edge signal (if they do not) is led through the sensing fibers 4 and 54 to the photo-sensor 5 and 55. The cloth-edge signal can be discriminated from the pattern signal by the strength of the reflected light because the guide plates 103 and 105 have a high reflectance.

The photo-sensors 5 and 55 generate a voltage signal corresponding to the strength of the reflected light. The voltage signal is sent through respective amplifiers 6 and 56 to an A/D (analog-to-digital) converter 7, which converts it into a digital signal and sends it on through an I/O (input and output) interface 8 to a CPU 9. The CPU 9, with ROM 10 and RAM 11, controls the initial setting of the photo-sensing system, which will be described later, and also controls various other operations of the pattern-matching sewing machine 12.

The I/O interface 8 also connects to a D/A (digital-to-analog) converter 13 that connects to a current/voltage converter 14. The current/voltage converter 14 is connected to the negative input terminal of a comparator 16. To the positive input terminal of the comparator 16 is connected a triangular-wave generator 15. An output terminal of the comparator 16 is connected to a light-emitter driver 17 which supplies current to the lamp 1.

The CPU 9 also connects, via the I/O interface 8, to: a motor driver circuit 40 that drives a main motor 50 of the sewing machine, an adjuster driver circuit 41 that drives the upper-feed adjusting mechanism 51; a needle position detector 42 that generates a needle-high signal and a needle-low signal, and a start switch 43 for starting and stopping sewing.

Figure 2:
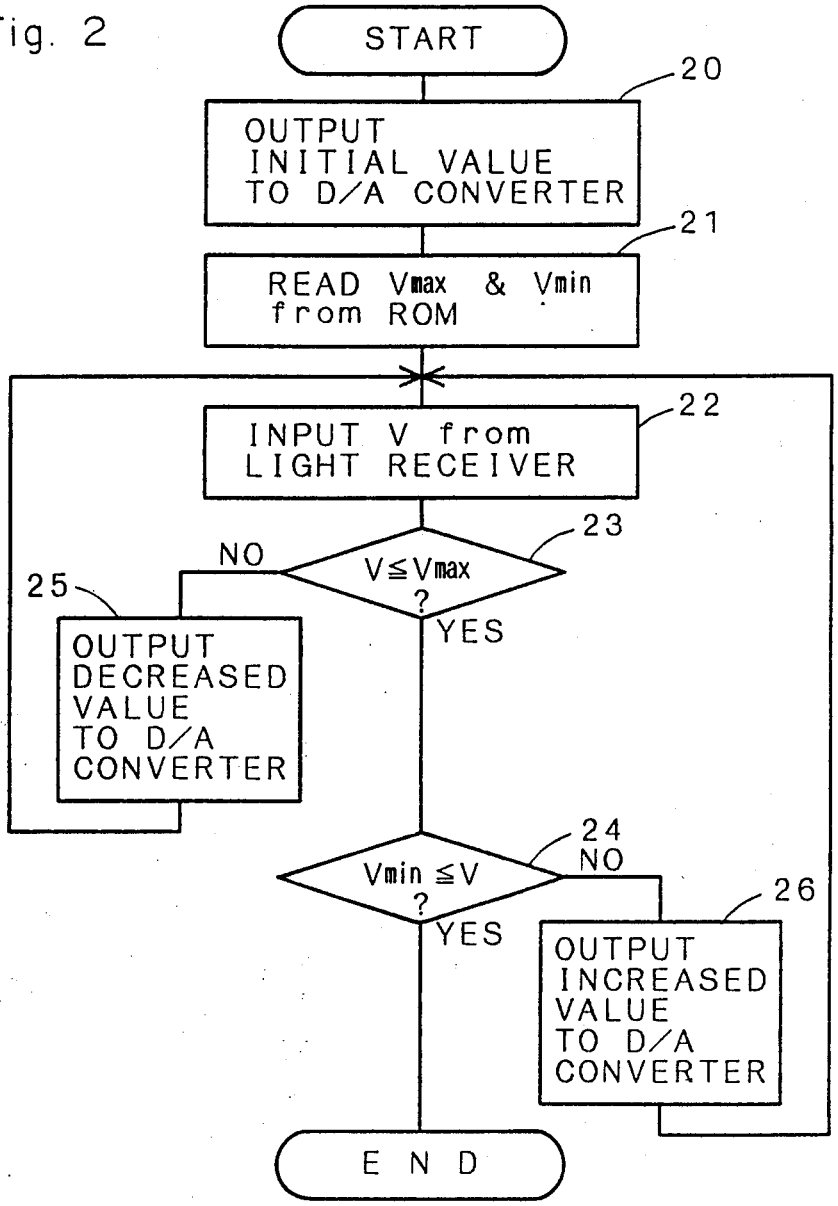
FIG. 2 is a flowchart of an initial sensor-setting program executed by the CPU of the sewing machine.
Figure 4:
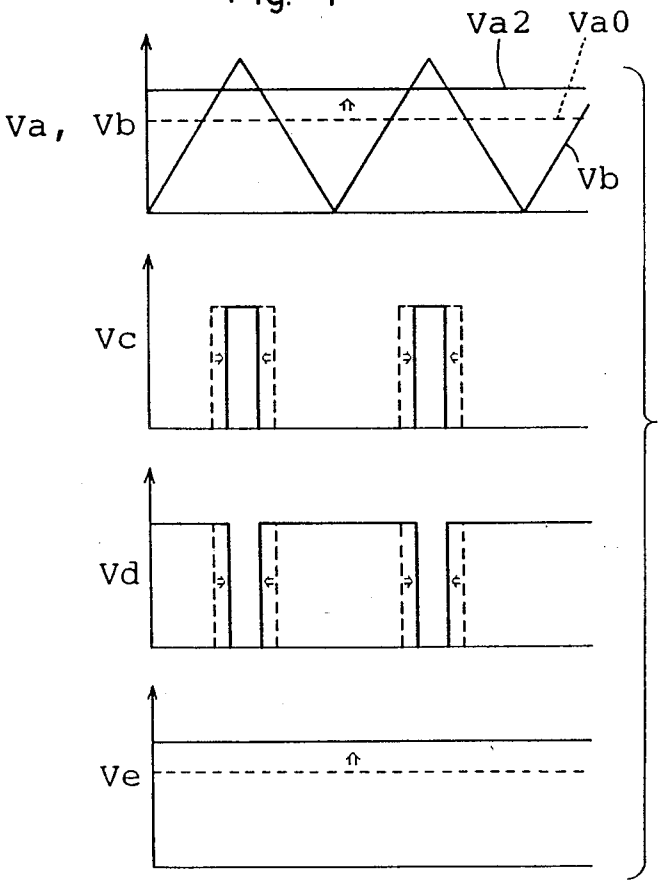
FIGS. 3 and 4 are timing charts of voltage changes at several points of the sensor circuit labeled in FIG. 1.
Figure 3:
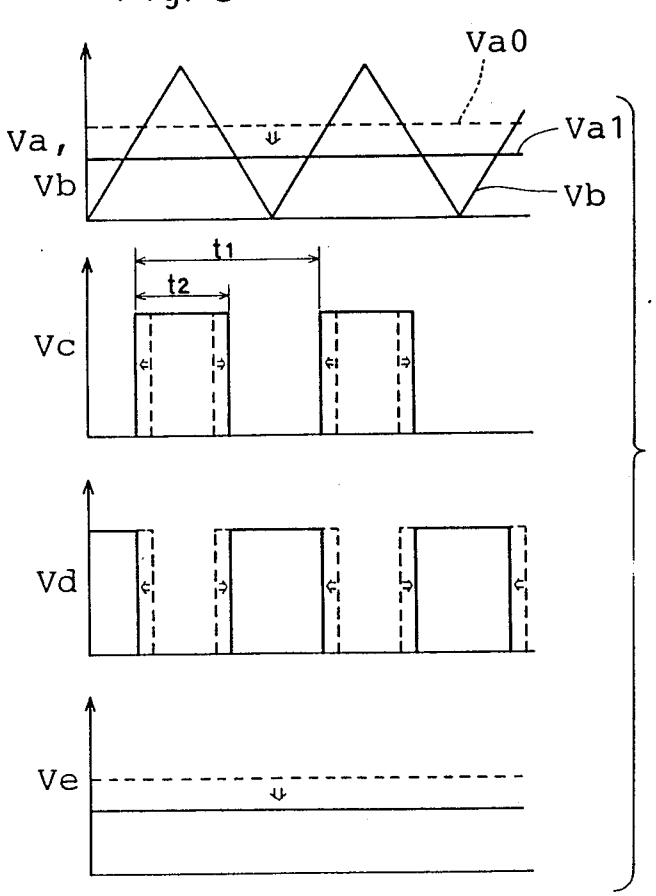

The initial setting of the photo-sensor is executed by the CPU 9 according to the program shown in FIG. 2 stored in the ROM 10. When the power switch of the sewing machine is turned on with no cloth at the sensing tip of the probe 3, the CPU 9 starts the initial setting control. First the CPU 9 reads preset initial-level data from the ROM 10 and sends it to the D/A converter 13 through the I/O interface 8 at step 20. The D/A converter 13 sends an initial-level voltage signal corresponding to the initial-level data through the current-/voltage converter 14 to the negative input terminal of the comparator 16. With the initial-level voltage signal VaO input into the negative input terminal and a triangular wave signal Vb input into the positive terminal from the wave generator 15, as shown in FIGS. 3 and 4, the comparator 16 generates a pulse signal Vc whose duty ratio (the ratio between the length of a high pulse t2 and the cycle of a whole pulse t1) is inverse to the initial-level voltage signal VaO. The pulse signal Vc is input into the emitter driver 17 which inverts Vc into Vd and supplies a current having a duty ratio proportional to the initial-level voltage signal to the lamp 1.

The CPU 9 also reads the preset upper and lower limit voltage values, Vmax and Vmin, from the ROM 10 at step 21.

The light emitted from the lamp 1 according to the initial-level data is reflected by the high-reflectance guide plates 103 and 105, and returns to the photo-sensors 5 and 55. In response to the strength of the received light, an initial return voltage signal Ve is generated by the photosensors 5 and 55, and is sent to the CPU 9 through the amplifiers 6 and 56, the A/D converter 7, and the I/O interface 8 at step 22. The value V of the return voltage signal Ve is compared with the upper and lower limit voltage values Vmax and Vmin at steps 23 and 24. If V is between Vmax and Vmin, the initial setting routine ends here because the photo-sensor needs no adjustment.

If V exceeds Vmax, the CPU 9 outputs a voltage level signal Va1 that is preset one small unit lower than the initial level Va0, as shown in FIG. 3, to the negative input terminal of the comparator 16 at step 25. This decreases the duty ratio of the driving voltage Vd of the lamp 1 and the strength of light emitted by it. The light is then received by the photo-sensors 5 and 55, again converted to the return voltage signal Ve at step 22, and the steps 23 and 25 are repeated. The strength of the light emitted by the lamp 1 is thus decreased by one preset small unit at a time until the return voltage value V comes between Vmax and Vmin.

When the initial return voltage value V is lower than the lower limit value Vmin, the initial-level voltage Va0 applied to the negative input of the comparator 16 is increased by one preset unit at step 26, as in FIG. 4, and a similar process is repeated until V rises between Vmin and Vmax.

Figure 5:
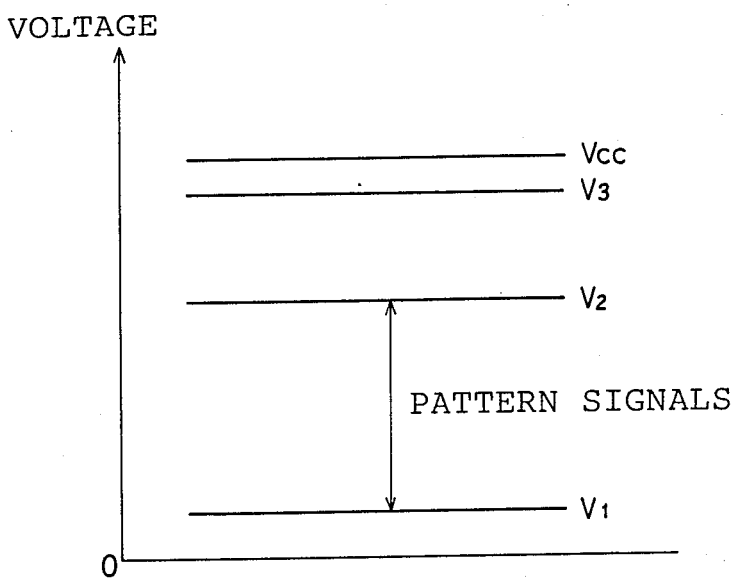
FIG. 5 is a graph illustrating the output voltages of the photo-sensor.

Thus, the initial setting of the photo-sensor system is finished and normal operations of the pattern-matching sewing machine are started. Since the strength of the lamp 1 is adjusted so that the light reflected by the cloth surface and by the guide plates 103 and 105 always falls within the normal operable range of the photo-sensors 5 and 55, the pattern signal and the cloth-edge signal both generated by the photo-sensors 5 and 55 are correctly discriminated as shown in FIG. 5. Further, various patterns can also be correctly discriminated because the pattern signal latitude (V1–V2) has a sufficient breadth.

The pattern-matching actions of the sewing machine is explained next. Two cloths 87 and 88 having the same pattern are first laid with their patterns mutually aligned, and inserted into the spaces between the guide plates 103, 104 and 105, respectively. When the start switch 43 is turned on with the upper and lower cloths 87 and 88 at the sensing tip of the probe 3, the CPU 9 starts the main motor 50. During sewing, the upper and lower cloths 87 and 88 are simultaneously fed by the lower feed dogs 65 and the presser foot 89, and the photo-sensors 5 and 55 generate the pattern signals of the upper cloth 87 and the lower cloth 88, respectively. Based on the two pattern signals, the CPU 9 calculates a mismatch distance of the upper and lower patterns and drives the upper-feed adjusting mechanism 51 to give only the upper cloth 87 a supplementary feed to restore the correspondence.

When the end edges of the cloths 87 and 88 pass the sensing tip of the probe 3, the high-level cloth-edge signal is generated by the photo-sensors 5 and 55. At this time, the CPU 9 counts a predetermined number of stitches using the signal from the needle position detector 42 and then stops the main motor 50.

Many modifications and variations of the present invention are possible in light of the above teachings. It is therefore to be understood that, within the scope of the appended claims, the invention may be practiced other than as specifically described. For example, a standard cloth (e.g. a white cloth) may be used as the standard reflection surface instead of the guide plates 103 and 105. In this case, the upper and lower limit values are correspondingly changed to assure the normal operations of the photo-sensor 5 and 55 for any light reflected from the patterns and guide plates 103 and 105. Further, while the setting of the photo-sensor system is done only after the power to the sewing machine is turned on in the above embodiment, the same setting can be done every time the CPU 9 receives the cloth-edge signal, which assures an even more reliable functioning of the photosensor system.

What is claimed is:

1. A cloth pattern sensing device for a sewing machine, the sensing device comprising:

a light-emitting element for emitting light on a cloth;

a light-receiving element for receiving the light influenced by patterns of the cloth and for generating an output corresponding to an intensity of the received light;

a standard reflection surface for reflecting the light from the light-emitting element to the light receiving element with a fixed reflectance;

memory means for storing preset upper and lower limit output values for the light-receiving element corresponding the light reflected by the standard reflection surface, the limit values being determined so that all light received by the light-receiving element falls within its normal operable range; and an emitter controller for controlling a strength of light emitted from the light emitting element so that the light-receiving element, in response to the light reflected by the standard reflection surface, generates an output within the upper and lower limit values.

2. The cloth pattern sensing device according to claim 1, wherein the emitter controller comprises:

means for comparing the output of the light-receiving element with the upper and lower limit values;

means for decreasing the strength of light by a preset amount when the output exceeds the upper limit value; and means for increasing the strength of light by a preset amount when the output is lower than the lower limit value.

3. The cloth pattern sensing device according to claim 2, wherein:

the light-emitting element comprises a comparator, a triangular-wave generator connected to an input terminal of the comparator, and a duty-controlled emitter driver connected to an output terminal of the comparator; and the increasing means and the decreasing means respectively increase and decrease voltage levels input into another input terminal of the comparator.

4. The cloth pattern sensing device according to claim 1, wherein the light-emitting element generates a pattern signal when a cloth is present at a sensing point, and a cloth-edge signal when no cloth is present at the sensing point.

5. The cloth pattern sensing device according to claim 1, wherein the standard reflection surface is a cloth-guide plate having a reflectance higher than a brightest cloth which reflects light from the light-emitting element to the light-receiving element when no cloth is present.

6. The cloth pattern sensing device according to claim 5, wherein the light-receiving element generates a pattern signal in receiving the light reflected from the cloth, and a cloth-edge signal in receiving the light reflected from the cloth-guide plate.

7. The cloth pattern sensing device according to claim 4, wherein the emitter controller controls the light-emitting element based on the value of the cloth-edge signal generated by the light-receiving element.

8. The cloth pattern sensing device according to claim 6, wherein the emitter controller controls the light-emitting element based on the value of the cloth-edge signal generated by the light-receiving element.

9. The cloth pattern sensing device according to claim 1, wherein a control routine for controlling the light-emitting element is executed when the power to the sewing machine is turned on.

* * * * *